US011180957B2

(12) United States Patent
Ramos

(10) Patent No.: US 11,180,957 B2
(45) Date of Patent: Nov. 23, 2021

(54) DRILLING SYSTEM

(71) Applicant: Fibercore Limited, Southampton (GB)

(72) Inventor: Rogerio Tadeu Ramos, Eastleigh (GB)

(73) Assignee: Fibercore Limited, Southampton (GB)

( * ) Notice: Subject to any disclaimer, the term of this patent is extended or adjusted under 35 U.S.C. 154(b) by 0 days.

(21) Appl. No.: 16/639,659

(22) PCT Filed: Jun. 29, 2018

(86) PCT No.: PCT/GB2018/051835

§ 371 (c)(1),
(2) Date: Feb. 17, 2020

(87) PCT Pub. No.: WO2019/034834

PCT Pub. Date: Feb. 21, 2019

(65) Prior Publication Data

US 2020/0173236 A1 Jun. 4, 2020

(30) Foreign Application Priority Data

Aug. 17, 2017 (GB) ..... 1713227

(51) Int. Cl.
*E21B 7/15* (2006.01)
*E21B 7/06* (2006.01)
(Continued)

(52) U.S. Cl.
CPC ..... *E21B 7/065* (2013.01); *E21B 7/15* (2013.01); *E21B 10/60* (2013.01); *E21B 44/02* (2013.01)

(58) Field of Classification Search
CPC ..... E21B 7/14; E21B 7/15
See application file for complete search history.

(56) References Cited

U.S. PATENT DOCUMENTS 3,500,942 A 3/1970 Smith, Jr.
4,741,505 A 5/1988 Anderson
(Continued)

FOREIGN PATENT DOCUMENTS

CN 1500174 A 5/2004
CN 1628207 A 6/2005
(Continued)

OTHER PUBLICATIONS

International Search Report for Application No. PCT/GB2018/051835 dated Oct. 17, 2018, 3 pages.
(Continued)

*Primary Examiner* — Giovanna Wright
(74) *Attorney, Agent, or Firm* — Howard & Howard Attorneys PLLC

(57) ABSTRACT

A bulk material drilling system is described, the drilling system arranged to allow accurate directional control of a drill bit through bulk material via non-mechanical means, while providing real-time feedback on drill bit positioning. A drilling system (22) comprising; a bulk material drill bit (10) having; a sensing portion (18), one or more ports (16) for discharging output energy, the drilling system further comprising; an input portion (30) arranged to detect input parameters from the sensing portion, a controller (32) arranged to control output energy to the port; wherein the controller is further arranged to determine one or more ports to which the output energy is provided; wherein the controller is further arranged to control the discharge of the output energy; wherein the output energy discharge is non-uniformly applied to bulk material; wherein the discharge of the output energy is used to control the drill bit direction. The invention aims to prevent mechanical wear while providing effective steering of a drill bit through bulk material.

17 Claims, 4 Drawing Sheets

(51) Int. Cl.
*E21B 10/60* (2006.01)
*E21B 44/02* (2006.01)

(56) References Cited

U.S. PATENT DOCUMENTS

| | | | | |
|---|---|---|---|---|
| 5,678,644 | A * | 10/1997 | Fielder | E21B 10/26 175/391 |
| 5,896,938 | A | 4/1999 | Moeny et al. | |
| 6,164,388 | A | 12/2000 | Martunovich et al. | |
| 6,604,580 | B2 | 8/2003 | Zupanick et al. | |
| 7,172,038 | B2 | 2/2007 | Terry et al. | |
| 7,946,360 | B2 | 5/2011 | Orban et al. | |
| 8,573,327 | B2 | 11/2013 | Trinh et al. | |
| 9,394,745 | B2 | 7/2016 | Bayliss et al. | |
| 9,689,249 | B2 | 6/2017 | Samuel | |
| 2010/0000790 | A1 | 1/2010 | Moeny | |
| 2014/0027178 | A1 | 1/2014 | Jeffryes et al. | |
| 2016/0153240 | A1 | 6/2016 | Braga et al. | |

FOREIGN PATENT DOCUMENTS

| | | | |
|---|---|---|---|
| CN | 1926304 | A | 3/2007 |
| CN | 101487389 | A | 7/2009 |
| CN | 102918228 | A | 2/2013 |
| CN | 103124828 | A | 5/2013 |
| CN | 105658908 | A | 6/2016 |
| EP | 2388433 | A1 | 11/2011 |
| WO | 03069110 | A1 | 8/2003 |

OTHER PUBLICATIONS

Chinese Search Report for Application CN 2018800662516 dated May 26, 2021, 5 pages.
English language abstract for CN 1500174 A extracted from espacenet.com database on Jul. 14, 2021, 2 pages.
English language abstract for CN 1628207 A extracted from espacenet.com database on Jul. 14, 2021, 2 pages.
English language abstract for CN 1926304 A extracted from espacenet.com database on Jul. 14, 2021, 2 pages.
English language abstract for CN 101487389 A extracted from espacenet.com database on Jul. 14, 2021, 1 page.
English language abstract for CN 103124828 A extracted from espacenet.com database on Jul. 14, 2021, 1 page.
English language abstract for CN 102918228 A extracted from espacenet.com database on Jul. 14, 2021, 2 pages.
English language abstract for CN 105658908 A extracted from espacenet.com database on Jul. 14, 2021, 2 pages.

* cited by examiner

DRILLING SYSTEM

CROSS REFERENCE TO RELATED APPLICATIONS

The present application is a National Stage of International Patent Application No. PCT/GB2018/051835, which was filed Jun. 29, 2018, which claims priority to and all advantages of Great Britain Patent Application No. 1713227.5, which was filed on Aug. 17, 2017, entitled "Drilling System", the disclosures of which are specifically incorporated by reference in their entirety.

FIELD OF THE INVENTION

The present invention relates to a drilling system, in particular a drilling system for use in drilling through bulk material.

BACKGROUND TO THE INVENTION

Drilling boreholes is a technique employed by a number of industries. An industry whose existence is founded on the efficient and accurate drilling of boreholes is that of oil and gas exploration. Oil and gas can be extracted from source materials such as rock formations in which they are confined. In most cases, the source of these fuels lies several kilometres beneath the earth's surface, and can only be accessed through the use of large high-powered drilling systems.

Historically, drill strings of drilling systems have maintained a substantially vertical trajectory during operation. This vertical orientation places a number of limitations on the ability to exploit the chosen region fully. One such limitation is that a largely vertical drilling orientation leaves little margin for error in the initial decision of where to begin drilling. Should new information arise about the location of the optimum extraction region, an entire drill string must be dismantled and the process restarted. This carries immense cost implications, considering that the operation of large-scale drilling projects carries a huge daily expense. In some more recent marine drilling cases, the daily costs can be considerably higher than land-bound counterparts. It has often been shown that, during the process of drilling through bulk material, the direction of a drill can be difficult to control unless specifically designed with a directional control feature. As such, lack of directional control provides a further stringency on margin of error during the drilling process. In the above instance, it is however, highly likely that an accidental misdirection will occur due to the substantial variations in composition of the rock below the earth's surface. It has also become apparent that strata of interest containing raw fuels are invariably angled such that a vertical drill path would not enable maximum exposure of the borehole to the fuel-rich stratum.

To overcome a number of these limitations, it has become customary to provide a directional control mechanism during the drilling process. In many applications, it is desirable to deviate the direction of the borehole by directing the drill bit towards a more optimum source of raw material. Sometimes it is desirable to control the drill bit drilling direction to achieve a deviated borehole. In others it is desirable to control the drill bit drilling direction to keep a straight borehole. In the case of oil or gas well drilling, it is common to deviate from a vertical orientation in order to optimize the borehole contact with a desirable fuel rich underground formation.

In downhole drill string conformations it is customary to use drilling mud as lubricant to enhance the rotary action of the drill bit through what are invariably hard rock formations. As the drill string is in operation, drilling mud is returned to the surface together with extracted bore material. The composition of the returned drilling mud can be informative as to the positioning of the drill bit with respect to the chosen source material. This does however only provide delayed positional information, which can in some cases come too late, leading to the untimely release of high pressure gas and oil. Such a kick can be dangerous to operational personnel, cause damage to equipment and set back an operation for extended periods. In extreme cases, a blowout may occur. More recently, active control of the drill bit is done using information collected from sensors situated at or near the drill bit. This provides the operator with more accurate and immediate feedback based upon the positioning of the drill bit relative to the desired source material.

Mechanical methods are normally used to redirect the drill bit to a more desirable path for the resulting borehole. In some cases, an angle is introduced between the main axis of the drill bit and the drill string in order to deviate the borehole. In other cases, a combination of pads pushing against the borehole wall is used to push the drill bit towards the desirable direction. Mechanical methods such as these are frequently subject to mechanical failure. This mechanical failure can arise for many reasons, for example due to fatigue, entrapment, wear, tear, seizing of moving parts and other mechanical failure modes.

As an improvement to conventional drilling, newer technologies are emerging that involve pulse treating the bulk material with high-energy surges of electricity (U.S. Pat. Nos. 3,500,942A; 4,741,505A; 5,896,938A; 6,164,388A; and WO3069110A1). This affects movement of the drill through the bulk material by weakening the integrity of the bulk material at the drill bit. High-energy surges therefore provide an effective addition to conventional drilling systems, as the many modes of mechanical failure noted above are circumvented. There are, however, a distinct lack of effective methods of using high-energy surges to accurately control the direction of the drill bit in drilling systems.

It is therefore desirable to provide an enhanced drilling system that enables accurate directional control of a drill bit through bulk material via non-mechanical means, while providing real-time feedback on drill bit positioning.

SUMMARY OF THE INVENTION

In accordance with a first aspect of the present invention, there is provided A drilling system comprising; a drive mechanism; a bulk material drill string with a bulk material drill bit; the drill bit having one or more output energy discharging ports, the drilling system further comprising;

a sensing portion; an input portion arranged to detect input parameters from the drill bit sensing portion and a controller arranged to control output energy to the port; wherein the controller is further arranged:

(i) to determine one or more ports to which the output energy is provided;

(ii) to control the discharge of the output energy;

whereby the output energy discharge is non-uniformly applied to bulk material and is used to control the drill bit direction.

The present invention does not use the traditional mechanical methods of directing a drill bit. This represents a great advantage over traditional methods, which are subjected to mechanical failure due to fatigue, entrapment, wear, tear, seizing of moving parts and other mechanical failure modes.

The drilling system of the present invention provides high-energy pulses to bulk material adjacent to the drill bit in a manner that facilitates accurate steering of the drill bit. In a preferred embodiment of the present invention, the high-energy pulses are provided to desired ports of the drill bit such that the high-energy pulses are applied to the surface of the bulk material in a non-uniform manner. More preferably, a controller is used to synchronize the provision of the high-energy pulses to selected ports of the drill bit, such that the high-energy pulses are discharged at a desired point of rotation of the drill bit. The discharge of the high-energy pulses from selected ports of the drill bit at a desired point of rotation provides a non-uniform application of the energy discharge across the bulk material. The non-uniformity of the application of the discharge across the surface of the bulk material causes a weakening of the mechanical integrity of a desired portion of bulk material at the drill bit surface. Upon weakening of the desired portion of bulk material, continued drilling using the drilling system of the present invention is inclined to follow a path of least resistance—this being the area of bulk material at the drill bit surface with the weakest mechanical integrity. The newly weakened portion of the bulk material provides the path of least resistance, and therefore the direction of steering, for continued drilling using the drilling system of the present invention. Thus the drilling system is accurately steered through the bulk material in the desired direction through successively weakening desired portions of the bulk material in a non-uniform manner such that the drilling system can follow the chosen path providing least resistance to motion.

In a preferred embodiment of the present invention, the positional adjustment of the drill bit is directed by the receipt of real-time sensor information relating to properties of the surrounding environment of the drill bit. Optionally, the sensors can be arranged to provide information about the proximity of desired raw materials. If the sensor is arranged to enable the detection of raw materials, the present invention can optionally be used to avoid kicks and prevent a blowout from occurring.

The transmission of energy to the ports of the drill bit is preferably done via the drill string. This transmission may originate from a source above the ground or from a source positioned downhole as part of a bottom hole assembly (BHA). Additional embodiments will be conceivable wherein the energy source may be situated downhole but may not be comprised within a BHA. Preferably the end of the drill string distal to the ground surface and proximate the drill bit comprises energy transfer members that are arranged to facilitate transmission of the high-energy pulses to the ports of the drill bit upon alignment of the desired energy transfer members with the desired ports on the drill bit. Preferably the controller is arranged to detect the rotational position of the drill bit relative to the static position of the energy transfer member. The informational relating to the rotational position of the drill bit relative to the static position of the desired energy transfer members is preferably accessible to the controller via the sensing portion and input portion. In a preferable embodiment, the provision of high-energy pulses to the ports of the drill bit are synchronised to occur upon alignment of the ports of the drill bit with the energy transfer members on the end of the drill string proximate the drill bit.

In a preferred embodiment of the present invention, the drilling system further comprises a processing portion arranged to process parameters from the input portion and provide instructions to the controller.

The incorporation of a processing portion into optional embodiments of the present invention provides for the automation of the adjustment in steering provided by the controller, and informed by the sensing portion and the input portion. This automation can eliminate the incidence of human error possible in the timely interpretation of the information provided by the sensing portion. The sensing portion preferably provides information relating properties of the drill bit, including rotational speed, which can be provided at a rate too fast for human interpretation. It is therefore preferable that at least a portion of the actions of the controller are automated through the use of the processing portion.

According to preferable embodiments of the present invention, the drill string is arranged to provide fluid flow to the drill bit, and wherein the drill bit further comprises at least one jetting portion arranged to provide fluid flow out of the drill bit.

Preferably the drill string is arranged to provide drilling fluid flow to the drill bit to enable lubrication of the rotary action of the drill bit. This drilling fluid can also serve as a coolant to the drilling equipment as frictional forces can generate enormous amounts of heat. The drilling fluid can optionally allow for the removal of drill cuttings from the borehole and transport these to the surface. Another advantage of the drilling fluid, when provided at sufficient density, is to generate a level of hydrostatic pressure that is equal to or greater than that of the formation fluid that may be present within strata of bulk material being drilled. The composition of the drilling fluid can preferably be tailored to the drilling operation according to the composition of the bulk material being drilled. Information relating to the composition of the bulk material being drilled is preferably provided by the sensing portion, and can include the density, the porosity, and the resistivity of the bulk material being drilled. This information can inform an adjustment to the density of the drilling fluid provided to the borehole in order to counteract high pressure of formation fluids. Where high pressure of formation fluids exceeds that provided by the drilling fluid, there is a potential of the occurrence of a kick or, in extreme cases, a blowout. These aforementioned events are potentially catastrophic to the drilling operation. The energy of the drilling fluid flowing down the drill string may optionally be harnessed to provide energy toward the transmission of high energy pulses to the drill bit. In a more preferable embodiment the drill bit comprises jetting portions that receive drilling fluid from the drill string and provide drilling fluid flow out of the drill bit into the borehole.

A further preferable embodiment is defined wherein the drill string comprises a turbine.

The incorporation of a turbine within the drill string in a preferable embodiment enables the harnessing of energy within the drill string to provide a source for at least a portion of the energy provided in the transmission of high-energy pulses to the ports of the drill string. The use of a turbine in the drill string optionally provides a return of energy to make the drilling operation more economical and efficient. Preferably the turbine is located downhole. More preferably the turbine is comprised within a bottom hole assembly.

In a preferred embodiment of the first aspect of the present invention, the output energy is discharged between at least two ports.

The output energy is preferably applied to the surface of the bulk material in a non-uniform manner, in order to enables steering of the drill bit. The non-uniform application of the output energy is governed by a combination of, the selection of ports from which to discharge the output energy; and the synchronization of energy discharges to occur at a desired point of rotation of the drill bit. If only one port is used for the discharge of high-energy pulses at a desired point of rotation of the drill bit, the interval between pulses is at a maximum. In a preferred embodiment, this interval between pulses can be shortened by discharging energy from two or more desired ports.

This provides facility for adjusting the rate of weakening of the bulk material to account for the required level of weakening necessary based upon the properties of the bulk material. Adjusting the rate of weakening of the bulk material can therefore be controlled to suit different forms of bulk material, the properties of which can be detected by the sensing portion. Provided the bulk material is detected to be homogeneous throughout the desired drilling trajectory, the use of two or more ports for discharging output energy more frequently at a desired point of rotation can be used to adjust both the rate of drilling and the rate of steering the drill. This can therefore provide for better and additional adjustment of direction of the drill bit if necessary. Adjusting the rate of energy discharge by limiting the number of ports from which the output energy is released can also be used to increase or decrease drilling rate to better suit the composition of the bulk material being drilled. This allows drilling in a variety of bulk material compositions.

Preferably, the sensing portion comprises at least one from the range: accelerometer, gyroscope, electromagnetic sensor, compass, radiation sensor, gamma ray sensor, temperature sensor, pressure sensor, vibration sensor, sonic sensor, acoustic sensor, position sensor, rotation sensor, porosity sensor, density sensor, resistivity sensor, position sensor, displacement sensor, rotation sensor, frequency sensor.

The sensing portion can provide real-time updates on the properties of the drill bit and the properties of the environment surrounding the drill bit. These properties preferably include the orientation of the drill bit; the rotational speed of the drill bit; the direction of drilling; the speed and/or velocity of the drill bit; and the spatial configuration of ports on the drill bit. The environmental properties that can be provided in real-time by the sensing portion preferably include the temperature; the pressure; vibration data; sonic data; acoustic data; radiation data. In order to determine the correct rate of energy pulsing, which would be used to provide adequate steering, it is therefore necessary to receive regular feedback on the positioning of the drill bit, together with the properties of the surrounding environment of the drill bit. The data can be used to determine the composition of the surrounding bulk material and can therefore be used to estimate the proximity of the drill bit to a desired raw material. Determining the proximity to a desired raw material, in conjunction with additional data such as pressure, temperature and vibration, can be useful in detecting the likelihood of a kick or a blowout occurring, and can be used to inform of a required adjustment to the rate of drilling or the direction of the drill bit accordingly. The sensed information can likewise be used to detect the proximity to an undesired material or location and as such can be used to provide timely information as to a necessary adjustment to the rate of drilling or the direction of steering of the drill bit.

The output energy preferably comprises at least one from the range: electrical, electromagnetic, light, laser, radiation, acoustic, plasma, vibration.

One from several different forms of energy can be discharged from the ports on the drill bit and as such the drilling operation can be tailored according to various drilling environments and different compositions of bulk material, among other delineating factors between different drilling operations.

Preferably the port comprises at least one from the range: electrode, antenna, optical port, transducer (acoustic energy port).

The energy ports can preferably be one of a selection from electrodes, antennas or optical ports. If optical radiation is used as energy, a laser or an optical fiber laser can be used to transmit the optical radiation. In the case of using electrical discharges, electrodes can be used as energy ports and those electrodes can have guard electrodes to better direct the discharges in the desired manner. The guard electrodes can take the form of a conductive ring around the electrode. The electrical potential at the guard electrode may be adjusted to direct the discharge towards the bulk material. The energy may optionally be generated, or generated and transmitted, from at least one down hole location or from at least one surface location. Optionally the pulses may comprise energy generated, or generated and transmitted, from a combination of down hole and surface locations.

In a preferred embodiment, the output energy source is at least one from the range: fluid flow through or near the drill bit, turbine in the drill string.

The energy discharges can preferably be adjusted to better fit the bulk material being drilled. This can be done by modulating the intensity, frequency or duty cycle of the discharge. The discharge may also produce localized plasma. A fluid may be used to cool or lubricate the drill bit. A fluid—which can optionally be the same fluid used to cool or lubricate the drill bit—may even be used to remove drilling cuttings from the borehole. Where fluid is used to remove drilling cuttings from the borehole, wherein the same fluid may have also been used to cool or lubricate the drill bit, this fluid preferably provides at least a portion of the energy required for energy discharge from the ports. The drilling fluid may also be designed to facilitate or enable the energy discharge or transfer of energy. This may be enabled through the adjusting of parameters relating to the drilling fluid such as conductivity, index of refraction, and/or absorption, among others. The provision of at least a portion of the energy required for energy discharges from the ports may be aided through the use of a turbine dynamo system. A number of additional modes of harnessing energy from this fluid flow will also be apparent. Preferably the drill string supporting the drill bit is hollow, allowing the flow of fluid.

Preferably the output energy is stored in at least one from the range: capacitor, super-capacitor, battery.

The energy to be supplied for use in providing high-energy pulses to the ports of the drill bit is preferably accessible through the use of at least one capacitor. More preferably this energy is accessible from a supercapacitor. More preferable still would be that the energy is accessible through the use of a battery. A most preferable arrangement combines the use of capacitor, supercapacitor and/or battery technology to provide the optimum access to available energy. This energy may optionally also be used to provide power to at least a portion of the drilling system.

In accordance with a second aspect of the present invention there is provided a method for drilling bulk material, wherein the method comprises at least one embodiment of a drilling system as according to the first aspect of the present invention.

In accordance with a third aspect of the present invention there is provided an optical fiber package arranged to transmit high-energy pulses.

Preferably the optical fiber package of the third aspect of the present invention is arranged to provide high-energy pulses of optical energy. In preferred embodiments the optical fiber package is arranged to be used within harsh applications. Optionally the optical fiber package comprises an optical fiber coating suited to high temperature and high pressure environments. The optical fiber coating may comprise a polymer coating, for instance wherein the polymer coating comprises polyimide. The optical fiber package preferably further comprises delivery optics. Optionally the delivery optics may take the form of a simple cleaved end. Optionally the delivery optics may comprise an optical window. Preferably the optical window comprises a lens for focussing. Preferably the optical window lens is used for focussing or collimating at least one stream of optical energy. Preferably the optical window further comprises materials suitable for the harsh environments presented during downhole drilling applications. These materials may comprise in at least a portion, silica, sapphire and diamond-like carbon (DLC).

In a preferable embodiment, the method of drilling bulk material according to the second aspect of the present invention comprises the use of at least one optical fiber package in accordance with the third aspect of the present invention.

Preferably the optical fiber package of the third aspect of the present invention is used in the transmission of the high energy optical pulses along the drill string to the end of the drill string proximate the drill bit, and optionally may be comprised within the port of the drill bit. Alterative embodiments are conceivable wherein an optical fiber package according the third aspect of the present invention may be used in at least a part of the sensing portion.

DETAILED DESCRIPTION

Specific embodiments will now be described by way of example only, and with reference to the accompanying drawings, in which.

Figure 3:
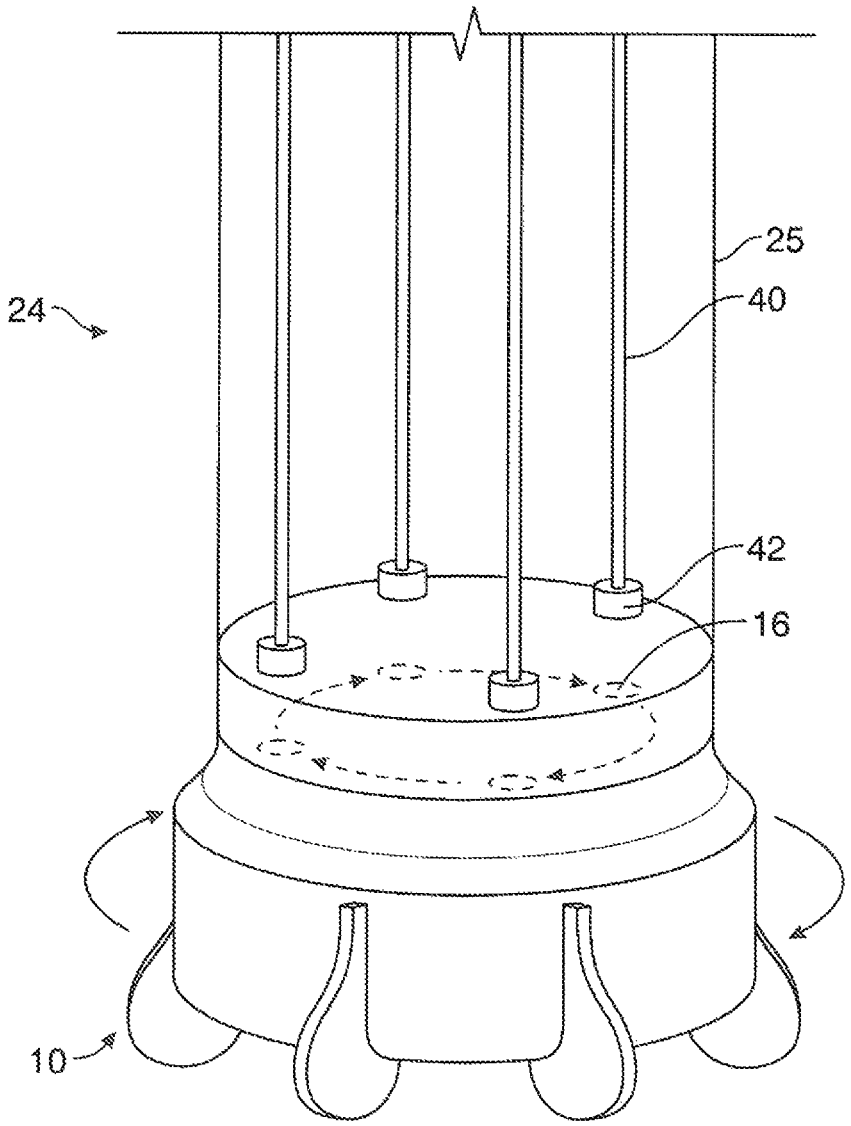
Figure 4:
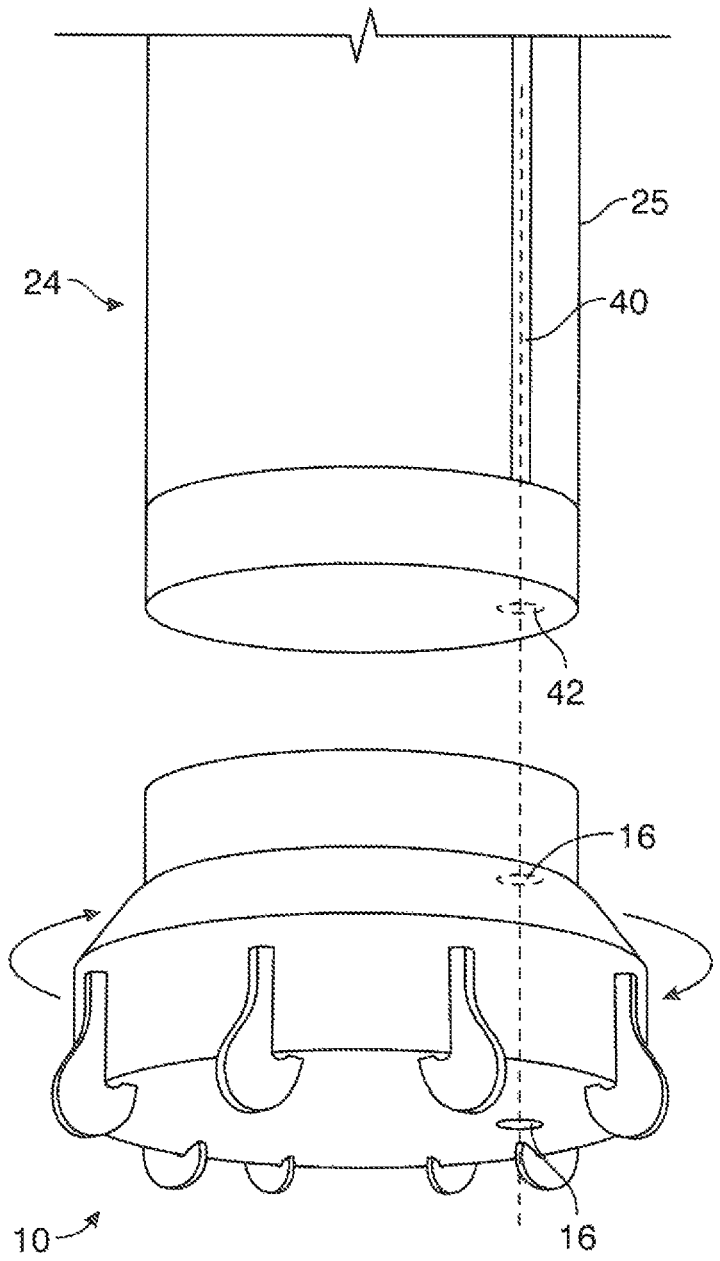

FIG. 3 shows a cutaway view of the end of the drill string proximate the drill bit in connection with the drill bit, comprising transmission lines for transmitting high energy pulses to the drill bit via energy transfer members; and FIG. 4 shows an exploded view of the end of the drill string proximate the drill bit wherein the port of the rotating drill bit and the energy transmission line and energy transfer member of the static drill string are aligned.

Figure 1:
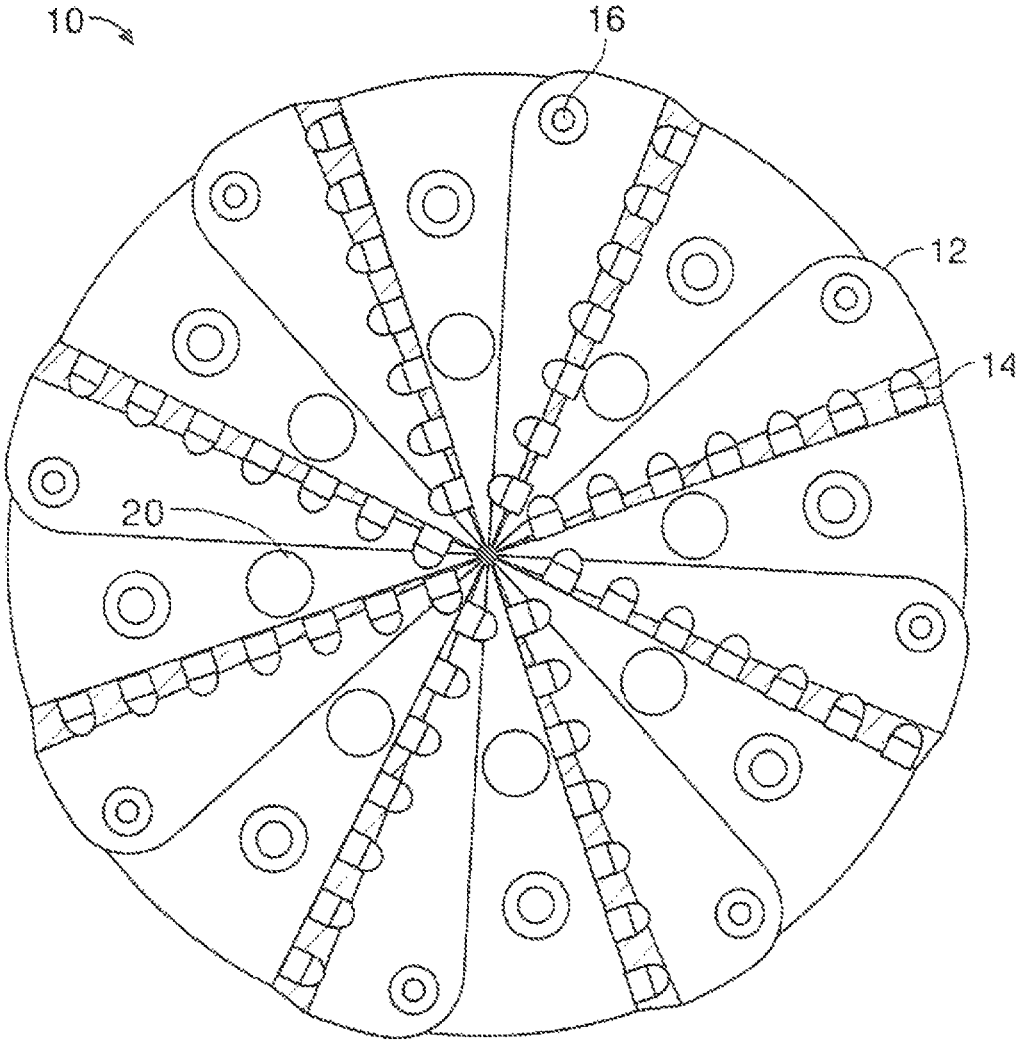
FIG. 1 shows a preferred embodiment of a drill bit according to a first aspect of the present invention.

Referring to FIG. 1, a preferred embodiment is shown in which drill bit 10 comprises a series of cutters 12 with teeth 14. Teeth 14 enable optimum drilling of the bulk material and in the embodiment shown in FIG. 1 are composed of silicon carbide. Other polycrystalline materials may provide optimum drilling through bulk material and may form part of the teeth 14 or another part of the drill bit 10. Alternative embodiments are available wherein the teeth 14 are not composed of silicon carbide or other polycrystalline material.

As shown in FIG. 1, located about the drill bit 10 are ports 16, from which energy discharges can occur. In the embodiment shown in FIG. 1, the ports 16 take the form of electrodes, antennae and optical ports. Optional alternative embodiments will be apparent comprising a variety of combinations of these ports 16, whereby the optional alternative embodiments may comprise one, two or all three types of the ports 16 described. That ports 16 take the form of electrodes, antennae and optical ports, means therefore that the energy discharge from these ports 16 can optionally be in the form of one selected from a range of electrical, electromagnetic, light, laser, radiation, or acoustic. In use, selection of these ports 16 is therefore optimised to suit the composition of the bulk material to be drilled. Sensing portion 18 (FIG. 2) can be used to determine properties of the drill bit 10 together with properties of an environment surrounding the drill bit 10. Properties of the drill bit 10 to be sensed preferably include the orientation of the drill bit 10; the rotational speed of the drill bit 10; the direction of drilling; the speed and/or velocity of the drill bit 10; and the spatial configuration of ports 16 on the drill bit 10. Environmental properties that can be provided in real-time by the sensing portion 18 preferably include the temperature; the pressure; vibration data; sonic data; acoustic data; radiation data. Additionally, the drill bit 10 preferably also comprises jetting portions 20, arranged to provide fluid flow to the drill bit 10. Preferably fluid flow from the jetting portions 20 is used to provide cooling and lubricating action to the drill bit 10. More preferably, fluid flow from the jetting portions 20 is used to remove drilling cuttings from the borehole 26 and therefore clear the path of the drill bit 10.

Figure 2:
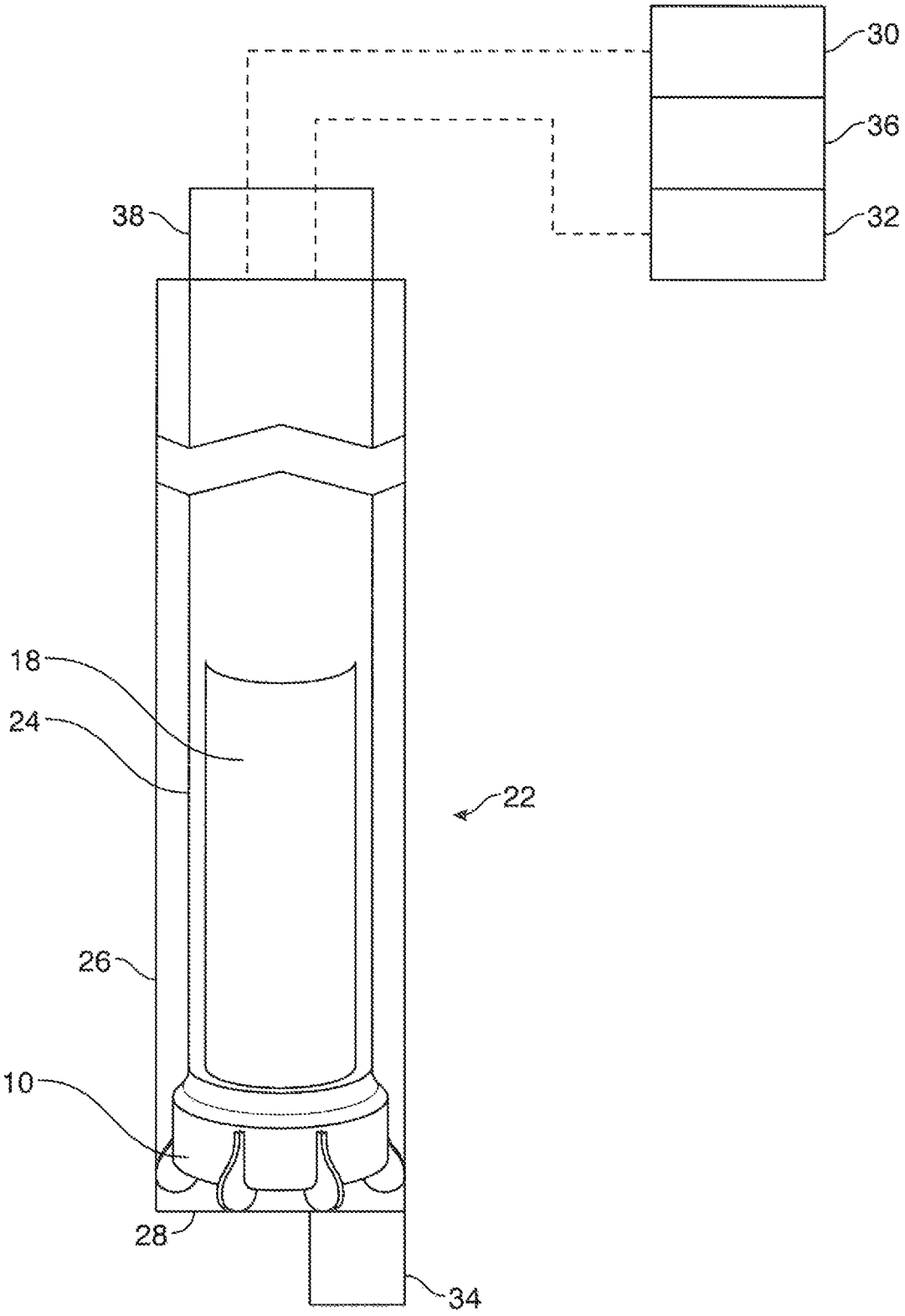
FIG. 2 shows a sectional diagram of a portion of a drilling system, including a drill string comprising a drill bit, as according to a first aspect of the present invention.

Referring to FIG. 2, a drilling system 22 comprises a drive mechanism 38, a drill string 24 and a drill bit 10, and is used to drill a borehole 26. In use drill bit 10 would rotate at a desired rotational speed, moving through the bulk material 28 to be drilled. The desired rotational speed of the drill bit 10 would be placed into effect by the drive mechanism 38. Properties obtained from the sensing portion 18, which in FIG. 2 is positioned at a downhole location on the drill string, to the input portion 30 are used to determine the orientation and direction of drilling of the drill bit 10 relative to the desired orientation and direction of drilling. A controller 32 is arranged to control the drive mechanism 38 and the provision of output energy to ports 16. Information from the sensing portion 18 is used to inform a change in the direction of the drill bit 10 in order that drill bit 10 conforms to the desired drilling direction. The controller 32 is used to determine the rate at which energy is pulsed to the ports 16 of the drill bit 10. Desired ports 16 are chosen according to the composition of the bulk material 28 to be drilled, and the corresponding form of energy to be used. Change of direction of drilling and therefore the orientation of drill bit 10 is carried out through the firing of high-energy pulses from the ports 16 at a portion 34 of the bulk material 28 to be drilled. The portion 34 of the bulk material 28 to be drilled is chosen according to the desired direction of drilling. High-energy pulses are timed as such to provide a rate of pulsing that applies repeated high-energy pulses to the same portion 34 of the bulk material 28 to be drilled. Repeated pulses are timed to occur from desired ports 16 of the drill bit 10 when the drill bit 10 reaches a desired point of rotation. That only the desired portion 34 of the bulk material 28 to be drilled is affected is a demonstration of the non-uniform application of the high-energy pulses. This non-uniform application of the high-energy pulses weakens the bulk material 28 non-uniformly in that only the desired portion 34 of the bulk material 28 is weakened. The continued drilling by the drill bit 10 is then encouraged to travel through the path of least resistance, this being the newly weakened portion 34 of the bulk material 28. The corresponding change in trajectory of the drill bit 10 therefore provides for effective steering of the drill bit 10. In this way the drilling process is directed by the weakening of the bulk material in a non-uniform way i.e. by using energy discharges.

In use, the sensing portion 18 provides information to the input portion 30, which can be used to inform the accurate pursuit of a desired region of bulk material 28. Sensing portion 18 also provides timely feedback on the properties of the drill bit 10, aiding in the early detection of problems relating to the drill bit 10 which can include properties of the drill bit 10 or the surrounding bulk material 28 to be drilled. Upon reaching proximity to a desired raw material, the composition of the bulk material 28 may change and the properties of the environment surrounding the drill bit 10 may be altered. If so, these alterations would be detected by the sensing portion 18 and used to inform an altering of the trajectory of the drill bit 10; the rate of drilling; or both. The properties detected by the sensing portion 18 can optionally include the porosity, the density, the pressure and the resistivity of the surrounding bulk material in order to inform the method or direction of drilling through the bulk material. The properties may also be used to detect the likelihood of kick. In extreme cases the likelihood of a blowout may be detected and this catastrophic event can be delayed or prevented. Embodiments will be conceivable wherein the sensing portion may be, at least in part, located on or proximate to the drill bit.

In alternative embodiments, a processing portion 36 may be used to process the information sensed by the sensing portion 18 and provided to the input portion 30. The processing portion 36 preferably then provides processed information to the controller 32. The processed information provided to the controller 32 is then preferably used to control an adjustment to the drive mechanism 38 or the manner of the provision of output energy to the ports 16. In this way, alternative embodiments may incorporate an automated response by the controller 32 to information provided by the sensing portion 18.

The input portion 30, controller 32, processing portion 36, drive mechanism 38 may be located on the surface of the bulk material to be drilled, as depicted in FIG. 2, or may be down hole and be co located with the drill string and drill bit 10.

Referring to FIG. 3 another optional embodiment is shown comprising the combination of the second and third aspects of the present invention. The end 25 of the drill string 24 proximate to the drill bit 10 is shown cut away to reveal the transmission lines 40 responsible for transmitting the high energy pulses comprising optical energy to the drill bit 10. The transmission of energy across the interface between the transmission lines 40 of the static drill string 24 and the ports 16 of the rotating drill bit 10 would require energy transfer members 42. The transmission lines 40 and the energy transfer members 42 comprise part of an optical fiber package wherein the transmission lines 40 comprise optical fibers and the energy transfer members 42 comprise optical windows. In the embodiment shown in FIG. 3 the transmission of the optical energy pulses to the desired port 16 of the drill bit 10 would require transmission across the interface between the energy transfer members 42 and the desired ports 16. Energy transmission therefore requires detection of alignment of the desired port 16 with an energy transfer member 42, wherein the detection of this rotational position of the drill bit 10 is provided by the sensing portion 18. Upon alignment of the desired port 16 with the energy transfer member 42, as shown in FIG. 4, and energy transmission across the interface and out of the port 16, the desired portion (for instance 34 as seen in FIG. 2) of the bulk material 28 is weakened. The trajectory of the drill bit 10 is thus through the portion 34 of the bulk material 28, which provides the least resistance, and therefore the direction of drilling is altered.

While the applications provided in the above embodiments primarily relate to the extraction and exploitation of raw materials, additional embodiments are conceivable wherein the application of the present invention to drilling bulk material is not related to the extraction or exploitation of raw materials. Additional applications may include the excavation of bulk material from a desired area.

The embodiment shown in FIG. 1 comprises jetting portions that are positioned equidistant from the centre of the drill bit. Embodiments of the present invention are available wherein there are no jetting portions, or where the at least one jetting portion is located anywhere on the drill bit.

It will be appreciated that the above described embodiments are given by way of example only and that various modifications thereto may be made without departing from the scope of the invention as defined in the appended claims.

The invention claimed is:

1. A drilling system comprising;
a drive mechanism; and
a bulk material drill string with a bulk material drill bit;
the drill bit comprising a series of cutters with teeth and having at least two output energy discharging ports, with each respective one of said at least two output energy discharging ports coupled to and extending within a corresponding one of the series of cutters,
the drilling system further comprising;
a sensing portion;
an input portion arranged to detect input parameters from the drill bit sensing portion and a controller arranged to control output energy to the port; wherein the controller is further arranged
(i) to determine one or more ports to which the output energy is provided;
(ii) to control a synchronized discharge of the output energy at a desired point of rotation of the drill bit through the at least two output energy discharging ports;
whereby the output energy synchronized discharge is non-uniformly applied to bulk material at the desired point of rotation of the drill bit and is used to control the drill bit direction.

2. A drilling system according to claim 1, wherein the system further comprises a processing portion arranged to process parameters from the input portion and provide instructions to the controller.

3. A drilling system according to claim 1, wherein the drill string is arranged to provide fluid flow to the drill bit.

4. A drilling system according to claim 3, wherein the drill bit further comprises at least one jetting portion arranged to provide fluid flow out of the drill bit.

5. A drilling system according to claim 1, wherein the drill string comprises a turbine.

6. A drilling system according to claim 1, wherein the sensing portion comprises at least one of an accelerometer, a gyroscope, an electromagnetic sensor, a compass, a radiation sensor, a gamma ray sensor, a temperature sensor, a pressure sensor, a vibration sensor, a sonic sensor, an acoustic sensor; a position sensor; a rotation sensor; a porosity sensor; a density sensor; a resistivity sensor, a position sensor, a displacement sensor, a rotation sensor, or a frequency sensor.

7. A drilling system according to claim 1, wherein the output energy comprises at least one of electrical energy, electromagnetic energy, light energy, laser energy, radiation energy, acoustic energy, plasma energy, or vibration energy.

8. A drilling system according to claim 1, wherein the port comprises at least one of an electrode, an antenna, an optical port, or a transducer.

9. A drilling system according to claim 1, wherein the output energy source is at least one of fluid flow through or near the drill bit, or a turbine in the drill string.

10. A drilling system according to claim 1, wherein the output energy is accessible from at least one of a capacitor, a super-capacitor, or a battery.

11. A drilling system according to claim 1, further comprising an optical fiber package arranged to deliver the output energy to the port.

12. A drilling system according to claim 1, wherein one port of the at least two ports is positioned within an opening contained within a corresponding one of the plurality of cutters.

13. A drilling system according to claim 12, wherein each one of the at least two ports are positioned within a respective opening on a different one of the plurality of cutters.

14. A drilling system according to claim 1, wherein each one of the at least two ports are coupled to and extend within a different one of the plurality of cutters.

15. A drilling system according to claim 1, wherein a first port of the at least two ports is positioned within an opening contained within a first one of the plurality of cutters and wherein a second port of the at least two ports is positioned within an opening contained within a second one of the plurality of cutters, with the second one of the plurality of cutters being adjacent to the first one of the plurality of cutters.

16. A drilling system according to claim 1 further comprising energy transfer members, and wherein an end of the drill string comprises a transmission line, and wherein the synchronized discharge of the output energy occurs across an interface between the transmission line and a respective one port of the at least two ports upon alignment of the respective one port and the transmission line.

17. A drilling system according to claim 16, wherein the interval between discharge of the output energy at the desired point of rotation decreases as the number of the two or more ports increases.

* * * * *